US011209191B2

(12) United States Patent
Wang et al.

(10) Patent No.: US 11,209,191 B2
(45) Date of Patent: Dec. 28, 2021

(54) EJECTOR CYCLE WITH DUAL HEAT ABSORPTION HEAT EXCHANGERS

(71) Applicant: Carrier Corporation, Jupiter, FL (US)

(72) Inventors: Jinliang Wang, Ellington, CT (US); Parmesh Verma, South Windsor, CT (US); Frederick J. Cogswell, Glastonbury, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 605 days.

(21) Appl. No.: 15/385,043

(22) Filed: Dec. 20, 2016

(65) Prior Publication Data

US 2017/0102170 A1 Apr. 13, 2017

Related U.S. Application Data

(62) Division of application No. 13/990,227, filed as application No. PCT/US2011/045004 on Jul. 22, 2011, now Pat. No. 9,523,364.

(Continued)

(51) Int. Cl.
*F25B 9/08* (2006.01)
*F25B 41/00* (2021.01)

(Continued)

(52) U.S. Cl.
CPC ..... *F25B 9/008* (2013.01); *F04D 7/00* (2013.01); *F25B 9/08* (2013.01); *F25B 41/00* (2013.01);

(Continued)

(58) Field of Classification Search
CPC ..... F25B 9/08; F25B 2341/0011; F25B 2341/0041; F25B 2400/0407;

(Continued)

(56) References Cited

U.S. PATENT DOCUMENTS 1,836,318 A 12/1931 Gay
3,277,660 A 10/1966 Kemper et al.

(Continued)

FOREIGN PATENT DOCUMENTS

CH 227856 7/1943
CN 101532741 A 9/2009

(Continued)

OTHER PUBLICATIONS

J.Q. Wan et al., Theoretical Analysis of the Refrigeration Cycle with New Type Liquid-Vapor Ejector, Mar. 1, 1997, pp. 516-520, vol. 2, Shanghai, China.

(Continued)

*Primary Examiner* — Frantz F Jules
*Assistant Examiner* — Daniel C Comings
(74) *Attorney, Agent, or Firm* — Bachman & LaPointe, P.C.

(57) ABSTRACT

A system has a first compressor and a second compressor. A heat rejection heat exchanger is coupled to the first and second compressors to receive refrigerant compressed by the compressors. The system includes an economizer for receiving refrigerant from the heat rejection heat exchanger and reducing an enthalpy of a first portion of the received refrigerant while increasing an enthalpy of a second portion. The second portion is returned to the compressor. The ejector has a primary inlet coupled to the means to receive a first flow of the reduced enthalpy refrigerant. The ejector has a secondary inlet and an outlet. The outlet is coupled to the first compressor to return refrigerant to the first compressor. A first heat absorption heat exchanger is coupled to the economizer to receive a second flow of the reduced enthalpy refrigerant and is upstream of the secondary inlet of the ejector. A second heat absorption heat exchanger is between the outlet of the ejector and the first compressor.

19 Claims, 9 Drawing Sheets

Related U.S. Application Data

(60) Provisional application No. 61/418,110, filed on Nov. 30, 2010.

(51) Int. Cl.
*F25B 9/00* (2006.01)
*F04D 7/00* (2006.01)

(52) U.S. Cl.
CPC . *F25B 2309/061* (2013.01); *F25B 2341/0011* (2013.01); *F25B 2341/0014* (2013.01); *F25B 2341/0015* (2013.01); *F25B 2400/0407* (2013.01); *F25B 2400/0409* (2013.01); *F25B 2400/23* (2013.01)

(58) Field of Classification Search
CPC ..... F25B 2400/0409; F25B 2400/23; F25B 2341/0015
USPC ..... 62/197, 510
See application file for complete search history.

(56) References Cited

U.S. PATENT DOCUMENTS

| | | | | |
|---|---|---|---|---|
| 3,592,017 | A | 7/1971 | Lipman et al. | |
| 4,787,211 | A | 11/1988 | Shaw | |
| 5,095,712 | A * | 3/1992 | Narreau | F25B 1/10 62/113 |
| 5,247,804 | A | 9/1993 | Paige et al. | |
| 5,533,338 | A | 7/1996 | Lee et al. | |
| 5,799,509 | A | 9/1998 | Finley et al. | |
| 6,161,394 | A | 12/2000 | Alsenz | |
| 6,216,474 | B1 | 4/2001 | Sishtla | |
| 6,397,621 | B1 | 6/2002 | Reynaud et al. | |
| 7,055,337 | B2 * | 6/2006 | Horn | B60H 1/00428 62/199 |
| 7,178,359 | B2 | 2/2007 | Oshitani et al. | |
| 8,424,338 | B2 | 4/2013 | Yamada et al. | |
| 2006/0042284 | A1 * | 3/2006 | Heberle | B60H 1/00428 62/236 |
| 2006/0254308 | A1 | 11/2006 | Yokoyama et al. | |
| 2006/0277932 | A1 * | 12/2006 | Otake | F25B 1/10 62/196.1 |
| 2008/0098754 | A1 * | 5/2008 | Sommer | F25B 41/00 62/115 |
| 2009/0095013 | A1 | 4/2009 | Ikegami et al. | |
| 2009/0178790 | A1 | 7/2009 | Schreiber et al. | |
| 2009/0229304 | A1 * | 9/2009 | Ogata | F25B 5/04 62/500 |
| 2010/0058781 | A1 | 3/2010 | Lifson et al. | |
| 2010/0326100 | A1 * | 12/2010 | Taras | F25B 1/10 62/115 |
| 2013/0125569 | A1 * | 5/2013 | Verma | F25B 1/10 62/115 |

FOREIGN PATENT DOCUMENTS

| | | | | |
|---|---|---|---|---|
| CN | 101532760 | A | 9/2009 | |
| EP | 1500535 | A1 * | 1/2005 | B60H 1/32 |
| EP | 1555493 | A2 | 7/2005 | |
| JP | 2001221517 | | 8/2001 | |
| JP | 2007147198 | A | 6/2007 | |
| JP | 2007315738 | | 12/2007 | |
| JP | 2009002649 | A | 1/2009 | |
| JP | 2009270745 | A | 11/2009 | |
| JP | 2009276049 | | 11/2009 | |
| WO | 2007111594 | A1 | 10/2007 | |
| WO | 2009041959 | A1 | 4/2009 | |

OTHER PUBLICATIONS

Ian Bell, Performance Increase of Carbon Dioxide Refrigeration Cycle with the Addition of Parallel Compression Economization, Aug. 29, 2004, Paris, France.

International Search Report and Written Opinion dated Jul. 5, 2012 for PCT/US2011/045004.

Chinese Office Action dated Sep. 12, 2014 for Chinese Patent Application No. 201180057591.0.

Chinese Office Action dated Mar. 13, 2015 for Chinese Patent Application No. 201180057591.0.

US Office Action dated Sep. 18, 2015 for U.S. Appl. No. 13/990,227.

US Office Action dated Mar. 23, 2016 for U.S. Appl. No. 13/990,227.

European Office action dated Mar. 7, 2018 for European Patent Application No. 11740772.6.

J.C. Goosmann et al., Recent Improvements in CO2 Equipment, Jul. 1928, The American Society of Refrigerating Engineers, Atlanta, Georgia.

* cited by examiner

EJECTOR CYCLE WITH DUAL HEAT ABSORPTION HEAT EXCHANGERS

CROSS-REFERENCE TO RELATED APPLICATIONS

This is a divisional application of U.S. patent application Ser. No. 13/990,227, filed May 29, 2013 and entitled "Ejector Cycle with Dual Heat Absorption Heat Exchangers", which is a 371 US national stage application of PCT/US2011/045004, filed Jul. 22, 2011, which claims benefit of U.S. Patent Application No. 61/418,110, filed Nov. 30, 2010, and entitled "Ejector Cycle", the disclosure of which is incorporated by reference herein in its entirety as if set forth at length.

BACKGROUND

The present disclosure relates to refrigeration. More particularly, it relates to ejector refrigeration systems.

Earlier proposals for ejector refrigeration systems are found in U.S. Pat. Nos. 1,836,318 and 3,277,660. A more recent proposal is found in U.S. Pat. No. 7,178,359.

SUMMARY

One aspect of the disclosure involves a system having a first compressor and a second compressor. A heat rejection heat exchanger is coupled to the first and second compressors to receive refrigerant compressed by the compressors. The system includes means for receiving refrigerant from the heat rejection heat exchanger and reducing an enthalpy of a first portion of the received refrigerant while increasing an enthalpy of a second portion. The second portion is returned to the compressor. An ejector has a primary inlet coupled to the means to receive a first flow of the reduced enthalpy refrigerant. The ejector has a secondary inlet and an outlet. The outlet is coupled to the first compressor to return refrigerant to the first compressor. A first heat absorption heat exchanger is coupled to the means to receive a second flow of the reduced enthalpy refrigerant and is upstream of the secondary inlet of the ejector. A second heat absorption heat exchanger is between the outlet of the ejector and the first compressor.

Other aspects of the disclosure involve methods for operating the system. This may comprise running the first and second compressors in a first mode wherein: the refrigerant is compressed in the first and second compressors; refrigerant received from the first and second compressors by the heat rejection heat exchanger rejects heat in the heat rejection heat exchanger to produce initially cooled refrigerant; the refrigerant received by the means from the heat rejection heat exchanger splits into said first portion and said second portion; the first portion is further split into said first flow received by the ejector primary inlet and said second flow passed through the first heat absorption heat exchanger to the ejector secondary inlet; and the first and second flows merge in the ejector and are discharged from the ejector outlet and passed through the second heat absorption heat exchanger to the first compressor.

In various implementations, the flow from the heat rejection heat exchanger is supercritical, the second portion flow of the first split is mostly sub-critical vapor, and the first portion flow of the first split is mostly sub-critical liquid. Operation in the first mode may be controlled by a controller programmed to control operation of the ejector, the first and second compressors, a controllable expansion device between the liquid outlet and the first heat absorption heat exchanger, and a controllable expansion device between the heat rejection heat exchanger and a flash tank of the means so as to optimize system efficiency. In an exemplary implementation, one expansion device controls the superheat of the refrigerant at the exit of the first heat absorption heat exchanger; the ejector controls the superheat of the refrigerant at the exit of the second heat absorption heat exchanger; and the other expansion device controls the state at the exit of the heat rejection heat exchanger.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
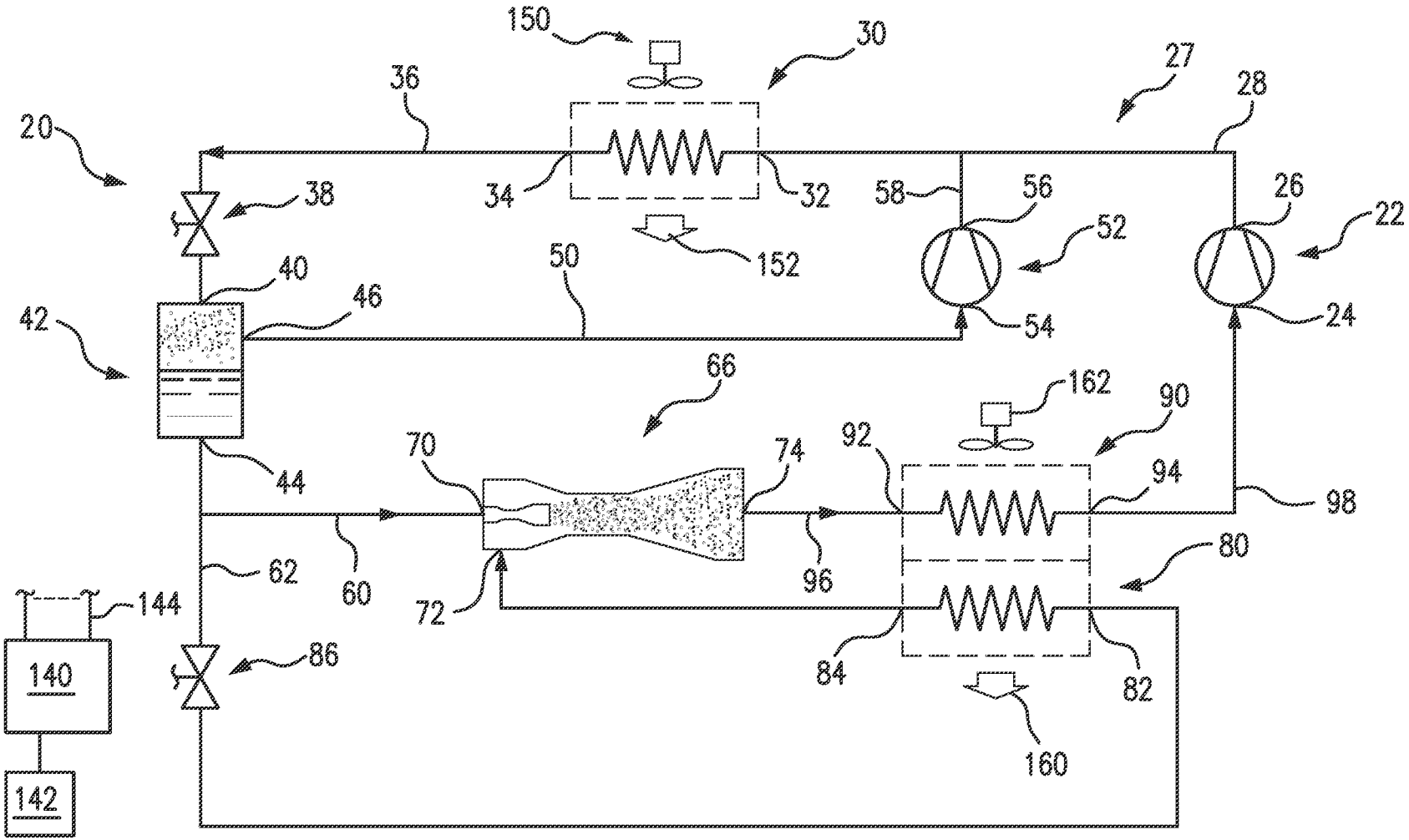
FIG. 1 is a schematic view of a first refrigeration system.

FIG. 1 shows an ejector refrigeration (vapor compression) system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to an inlet 40 of a flash tank 42. Upstream of the flash tank, a first expansion device 38 (e.g., an electronic expansion valve) is located in the line 36. The flash tank has a liquid outlet 44 and a gas outlet 46. A line 50 extends from the gas outlet 46 to the suction port 54 of a second compressor 52. The second compressor has a discharge port 56 which connects to a discharge line 58 merging with the discharge line 28 ahead of the gas cooler inlet 32.

As is discussed further below, the exemplary expansion device 38 and flash tank 42 provide a first economizer that serves as means for receiving refrigerant (e.g., from the gas cooler 30) and reducing an enthalpy of a first portion of the received refrigerant while increasing an enthalpy of a second portion. The second portion is returned to a second compressor whereas the first portion is further used in cooling. The exemplary first portion ends up being split into first and second flows. To divide and carry the first and second flows, respective branches 60 and 62 branch off downstream of the liquid outlet 44 and extend respectively to inlets of an ejector 66. The first branch 60 extends to a primary inlet (liquid or supercritical or two-phase inlet) 70 of the ejector 66. The second branch 62 extends to a secondary inlet (saturated or superheated vapor or two-phase inlet) 72. The ejector has an outlet 74.

The second branch 62 includes a heat exchanger 80 having an inlet 82 and an outlet 84. Upstream of the inlet 82, the second branch includes a second expansion device 86 (e.g., an expansion valve such as an electronic expansion valve). Downstream of the ejector outlet 74, the system includes a heat exchanger 90 having an inlet 92 and an outlet 94. A conduit 96 extends from the ejector outlet 74 to the heat exchanger inlet 92. A suction line 98 of the first compressor extends from the outlet 94 to the suction port 24. In the normal mode of system operation, the heat exchangers 80 and 90 are heat absorption heat exchangers (evaporators).

The exemplary ejector 66 (FIG. 2) is formed as the combination of a motive (primary) nozzle 100 nested within an outer member 102. The primary inlet 70 is the inlet to the motive nozzle 100. The outlet 74 is the outlet of the outer member 102. The primary refrigerant flow 103 (the "first flow" noted above) enters the inlet 70 and then passes into a convergent section 104 of the motive nozzle 100. It then passes through a throat section 106 and an expansion (divergent) section 108 through an outlet 110 of the motive nozzle 100. The motive nozzle 100 accelerates the flow 103 and decreases the pressure of the flow. The secondary inlet 72 forms an inlet of the outer member 102. The pressure reduction caused to the primary flow by the motive nozzle helps draw the secondary flow 112 (the "second flow" noted above) into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 72. The resulting combined flow 120 is a liquid/vapor mixture and decelerates and recovers pressure in the diffuser 118 while remaining a mixture.

Figure 3:
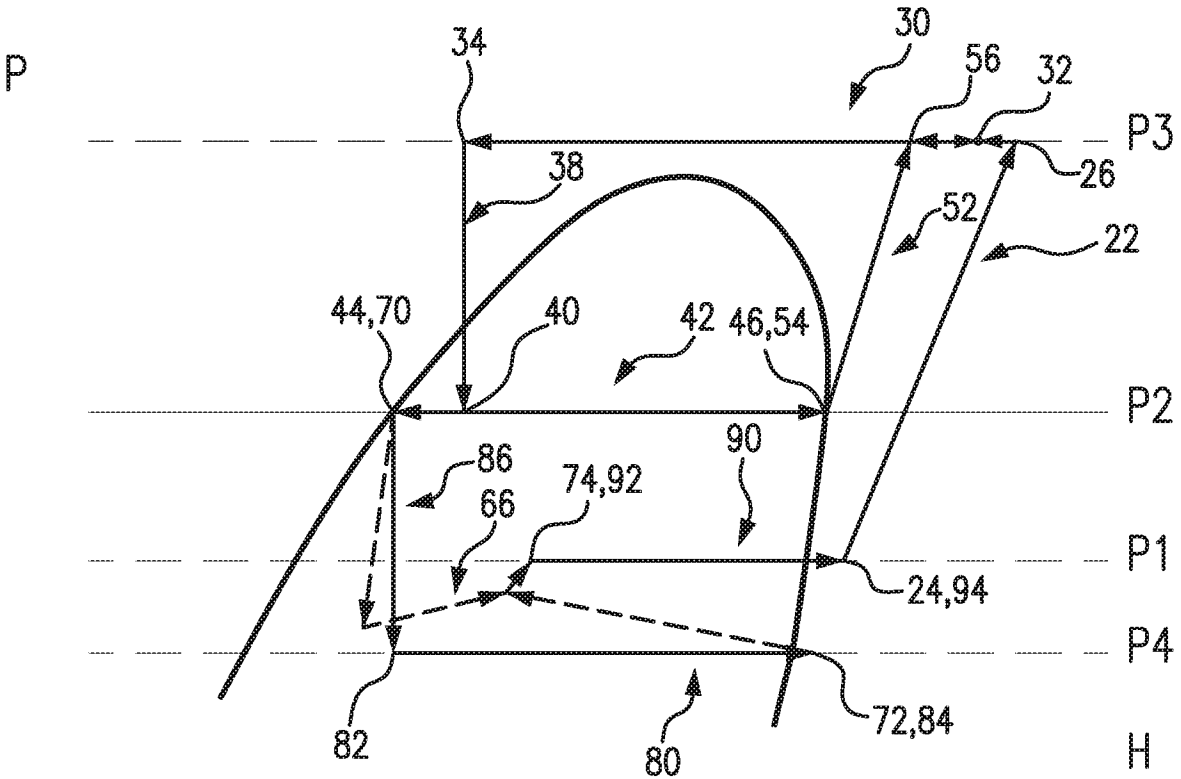
FIG. 3 is a simplified pressure-enthalpy diagram of the system of FIG. 1.

In the normal mode of operation (FIG. 3), gaseous refrigerant is drawn by the first compressor 22 through the suction line 56 and inlet 24 and compressed and discharged from the discharge port 26 into the discharge line 28. Similarly, gaseous refrigerant is drawn by the second compressor 52 through the line 50 and compressed and discharged from its discharge port 56 to the line 58 to merge with refrigerant from the first compressor discharge line 28. In the exemplary embodiment, the first compressor suction port 24 is at a first pressure $P_1$ and the second compression suction port 54 is at a pressure $P_2$. Both discharge to a high side pressure $P_3$. The exemplary first compressor 22 discharges at a higher enthalpy than the second compressor 52. Thus, the conditions at the inlet 32 of the gas cooler 30 represent an average of these two flows. In the heat rejection heat exchanger 30, the refrigerant loses/rejects heat to a heat transfer fluid (e.g., fan-forced air or water or other fluid). Cooled refrigerant exits the heat rejection heat exchanger via the outlet 34.

The cooled refrigerant is then expanded (e.g., at essentially constant enthalpy) in the first expansion device 38 and delivered to the flash tank 42 which is at a lower pressure (essentially the second compressor suction pressure $P_2$ in the exemplary embodiment). The flow thus has its first split, with a portion exiting the flash tank vapor outlet 46 to the second compressor suction port 54 for compression as discussed above.

Another portion exits the flash tank outlet 44 and, in normal operation, is further split with a first portion passing through the branch 60 to the ejector primary inlet 70 and a second portion being expanded in the second expansion device 86. The portion expanded in the expansion device 86 is expanded essentially constant enthalpy to a low side pressure $P_4$ of the first evaporator 80. That refrigerant passes through the first evaporator 80 and picks up heat. That flow then enters the ejector secondary inlet and merges with the flow from the first branch 60. The recombined flow enters the second evaporator 90 at essentially the first compressor suction pressure $P_1$.

Figure 2:
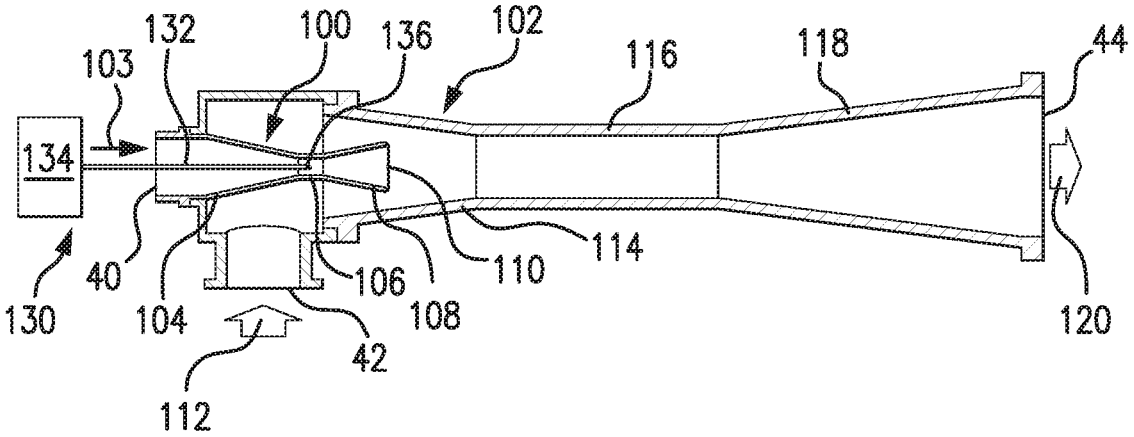
FIG. 2 PRIOR ART
FIG. 2 is an axial sectional view of an ejector.

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

As is discussed further below, in an exemplary embodiment, the ejector 66 is a controllable ejector such as described above. In the exemplary system, compressor speeds are also controllable as are the valves 38 and 86. This provides an exemplary five controlled parameters for the controller 140. The controller 140 receives sensor input from one or more temperature sensors T and pressure sensors P. FIG. 1 also shows a fan 150 (e.g., an electric fan) driving an airflow 152 across the gas cooler 30. One or more airflows may be similarly driven across the evaporators 80 and 90. In the exemplary embodiment, the evaporators 80 and 90 are part of a single evaporator unit (e.g., a single continuous array of tubes with the separate evaporators formed by separately headered sections of that array). An exemplary second fan 162 drives an airflow 160 across the evaporators 80 and 90. In the exemplary embodiment, the evaporator 90 is upstream of the evaporator along the air flowpath.

In the exemplary implementation, the flash tank outputs pure (or essentially pure (single-phase)) gas and liquid from the respective outlets 46 and 44. In alternative implementations, the gas outlet may discharge a flow containing a minor (e.g., less than 50% by mass, or much less) amount of liquid and/or the liquid outlet may similarly discharge a minor amount of gas.

In an exemplary control method, the controller 140 may vary control valve 38 in order to control the high-side pressure P3. For transcritical cycles such as $CO_2$, raising the high side pressure decreases the enthalpy out of the gas cooler and increases the cooling available for a given compressor mass flow rate. However, increasing the high side pressure also increases the compressor power. There is an optimum pressure value that maximizes the system efficiency at a given operating condition. Generally, this target value varies with the refrigerant temperature leaving gas cooler. A target high side pressure temperature curve may be programmed in the controller.

Controller 140 may also vary expansion valve 86 to control the amount of liquid entering the first evaporator 80. Typically valve 86 is used to control the superheat of the refrigerant leaving evaporator 80 at 84. The actual superheat may be determined responsive to controller inputs received from the relevant sensors (e.g., responsive to outputs of a temperature sensor T and a pressure sensor P between the outlet 84 and the ejector secondary inlet 72). To increase the superheat, the valve 86 is closed; to decrease the superheat, the valve 86 is opened (e.g., in stepwise or continuous fashion). In an alternate embodiment, the pressure can be estimated from a temperature sensor (not shown) along the saturated region of the evaporator. Controlling to provide a proper level of superheat ensures good system performance and efficiency. Too high a superheat value results in a high temperature difference between the refrigerant and air and, thus, results in a lower evaporator pressure. If the valve 86 is too open, the superheat may go to zero and the refrigerant leaving the evaporator will be saturated. Too low a superheat indicates that liquid refrigerant is exiting the evaporator. Such liquid refrigerant does not provide cooling and must be re pumped by the ejector. The target superheat value may differ depending on the operation mode. Because the ejector is tolerant of ingesting refrigerant, the target may be small (typically about 2K).

If ejector 66 is controllable, then controller 140 may also vary ejector 66 to control the amount and quality of the refrigerant entering the second evaporator 90. Increasing the flow decreases the superheat of the refrigerant leaving the evaporator at 94. The modulation of ejector 66 to control the refrigerant state at 94 is equivalent to the modulation of expansion valve 86 to control the refrigerant state at 84, as described above except that target superheat value is higher (typically 5K or more). The reason for this difference is that the second evaporator 90 is connected to the compressor suction port 24. The compressor may be less tolerant of ingesting liquid refrigerant.

The speed of compressor 22 may be varied to control overall system capacity. Increasing the compressor speed will increase the flow rate to the evaporators. Increased flow to the evaporators directly increases system capacity. The desired capacity, and therefore compressor speed, may be determined by the difference between evaporator entering air temperature and a setpoint temperature. A standard PI (proportional-integral) logic may be used to determine the compressor speed.

The speed of compressor 52 may be varied to control the intermediate pressure P2. Increasing the speed lowers P2 while decreasing the speed raises P2. The target value of P2 may be selected to optimize the system efficiency. Lowering P2 lowers the liquid temperature out of the flash tank at port 44 and increases the amount of cooling available, but at a cost of more power required for compressor 52.

The system may be fabricated from conventional components using conventional techniques appropriate for the particular intended uses.

Figure 4:
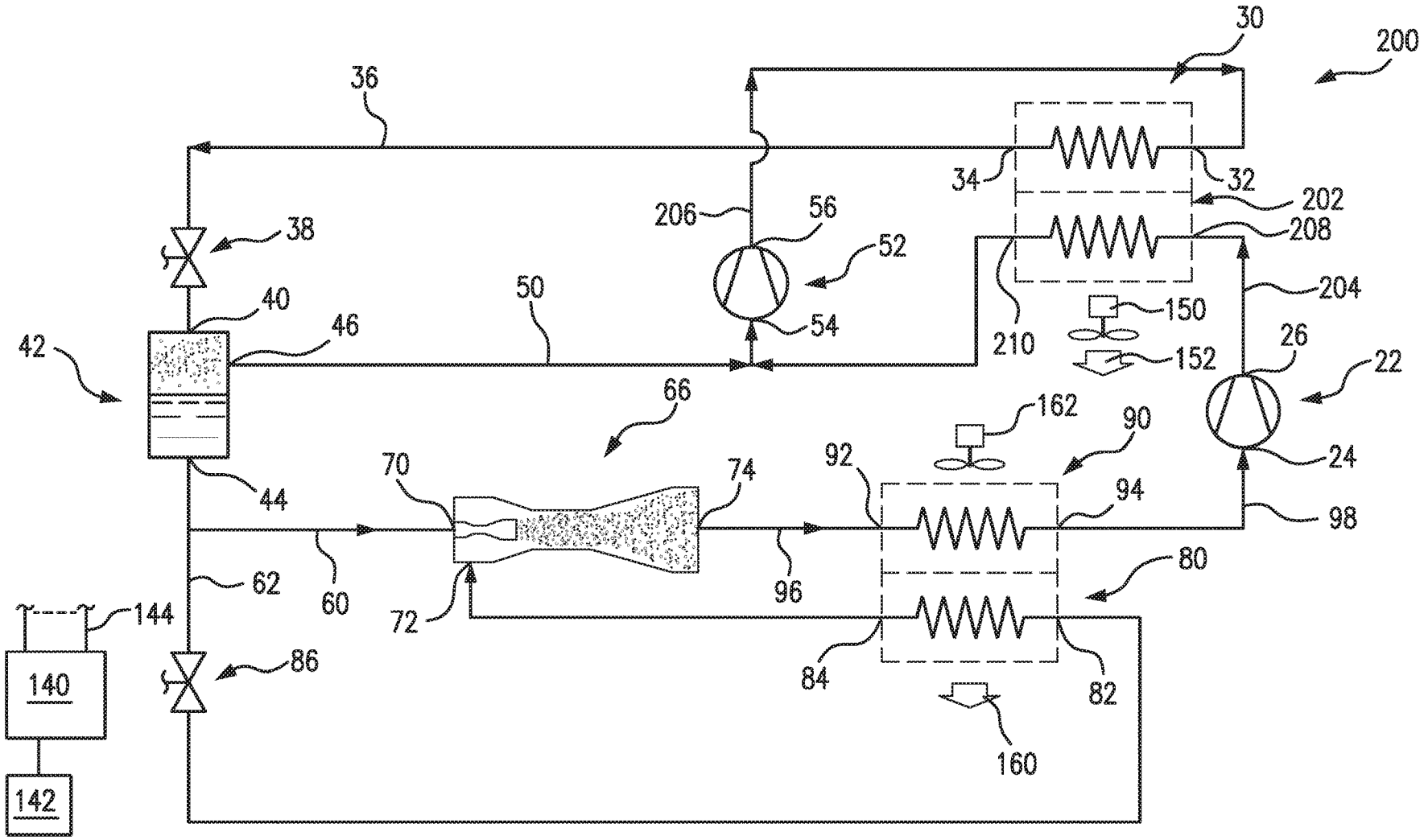
FIG. 4 is a schematic view of a second refrigeration system.

FIG. 4 shows an alternate system 200 which may be otherwise similar to the system 20. However, the system 200 places the compressors in partial series (rather than parallel) and adds an intercooler 202 between the compressors. The intercooler is located in a discharge line 204 of the first compressor 22 which replaces the line 28 and merges with the line 50 at suction conditions of the second compressor 52. The discharge line 56 of the second compressor is replaced by line 206 feeding the gas cooler inlet 32. The exemplary intercooler is an air-to-air heat exchanger having an inlet 208 and an outlet 210 along the line 204. The exemplary intercooler is in airflow series with the gas cooler 30 (e.g., so that the flow 152 passes first over the gas cooler 30 and then over the intercooler 202).

Figure 5:
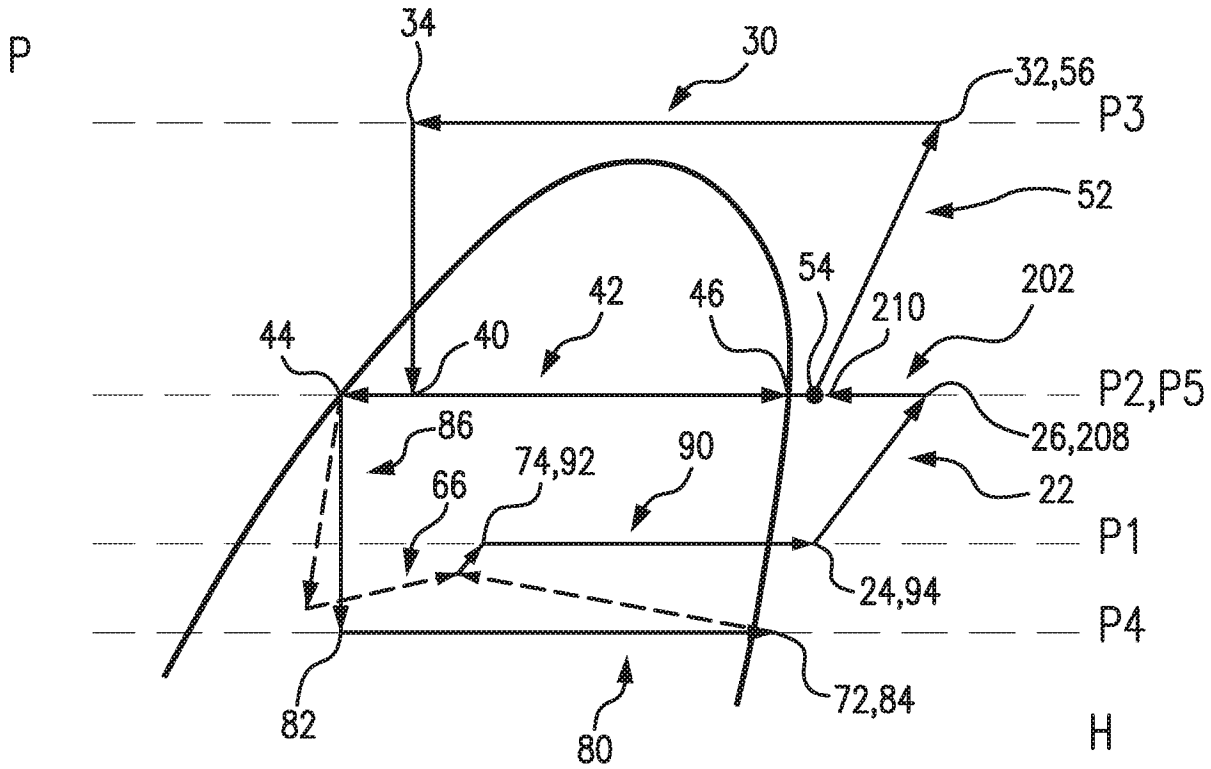
FIG. 5 is a simplified pressure-enthalpy diagram for the system of FIG. 4.

FIG. 5 is a P-H diagram for the system 200. The first compressor discharges to a discharge pressure P5 which is essentially the same as the second compressor suction pressure P2 and the pressure of the flash tank.

Figure 6:
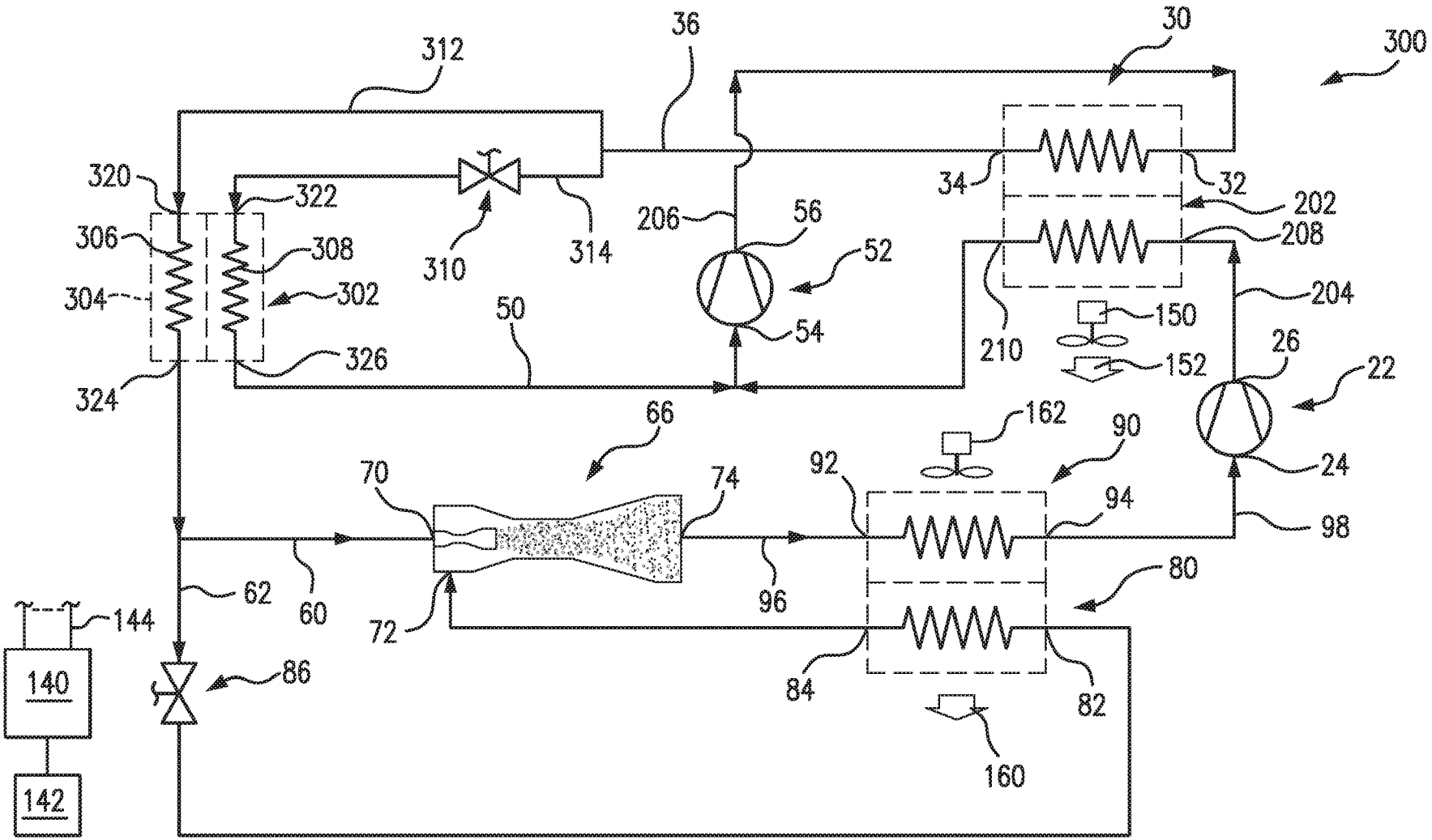
FIG. 6 is a schematic view of a third refrigeration system.

FIG. 6 shows an alternate system 300 which shares the exemplary partial series compressor operation and intercooler with the system 200. Accordingly, like components are numbered with like numerals. However, the flash tank economizer is replaced by an economizer system 302 having an economizer heat exchanger 304 and an expansion device 310 (e.g., an electronic expansion valve). The exemplary economizer heat exchanger is a refrigerant-refrigerant heat exchanger having a first leg 306 in heat exchange relation with a second leg 308. The gas cooler discharge line 36 branches into a first branch 312 along which the leg 306 is located and a second branch 314 along which the expansion device 306 and leg 308 are located. The first branch 302 feeds the branches 60 and 62 as did the output of the liquid outlet 44. The branch 314 feeds the second compressor as did the line 50. The legs 306 and 308 have respective inlets 320 and 322 and respective outlets 324 and 326.

Figure 7:
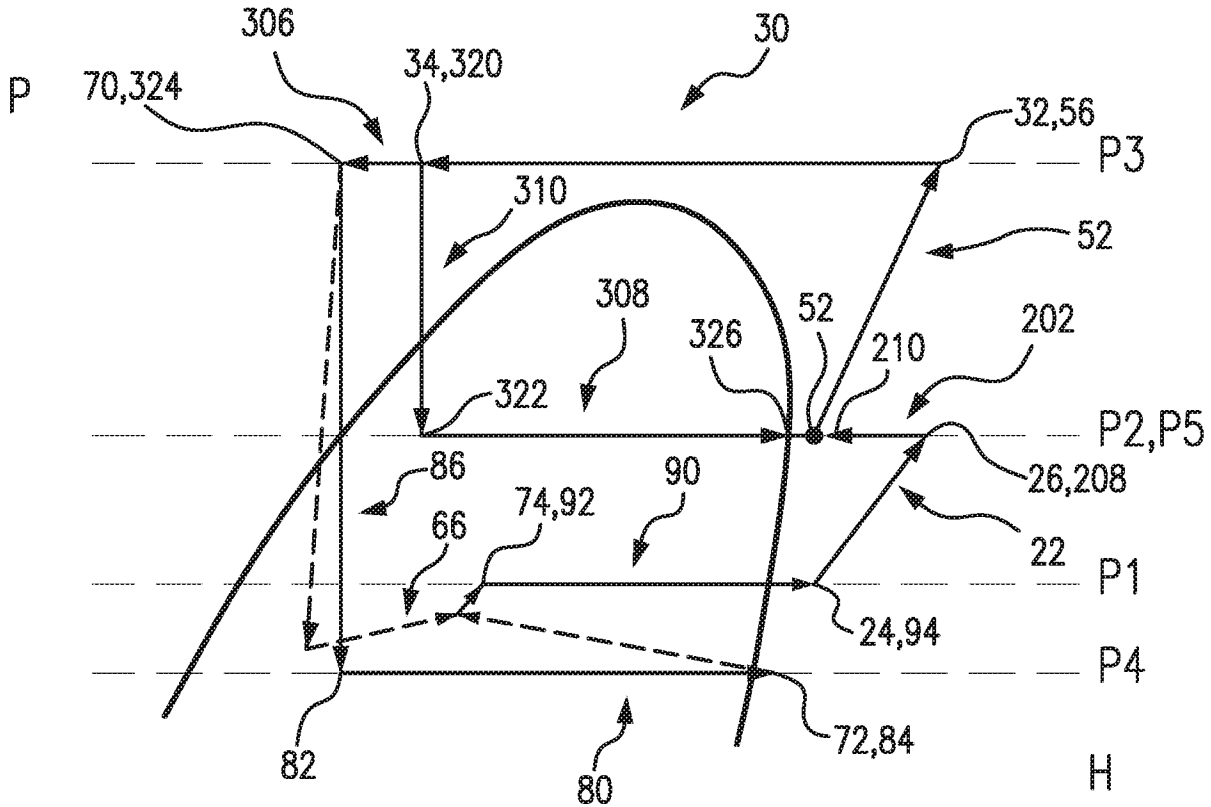
FIG. 7 is a simplified pressure-enthalpy diagram for the system of FIG. 6.

FIG. 7 is a P-H diagram for the system of FIG. 6.

Figure 8:
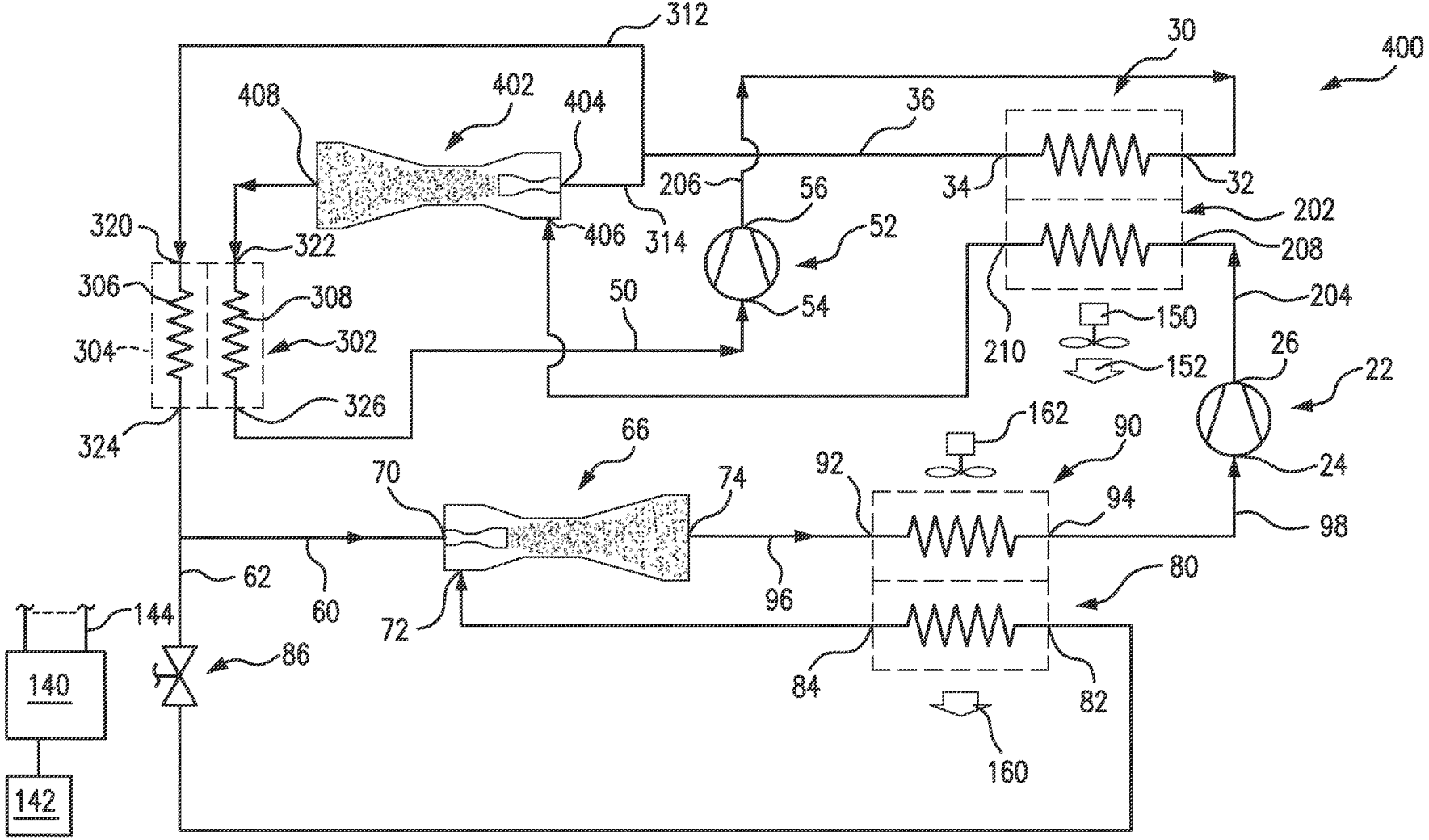
FIG. 8 is a schematic view of a fourth refrigeration system.

FIG. 8 shows an alternate system 400 that replaces the expansion device 310 with an ejector 402 in the economizer system 302. The ejector 402 may be similar to the ejector described above having a primary inlet 404, a secondary inlet 406, and an outlet 408. The primary inlet and the outlet are along the branch 314 upstream of the leg 308. The secondary inlet receives an output of the intercooler with the combined flow then passing through the outlet 408 and leg 308 to enter the second compressor inlet. Thus, the partial series operation is preserved relative to the systems 200 and 300.

Figure 9:
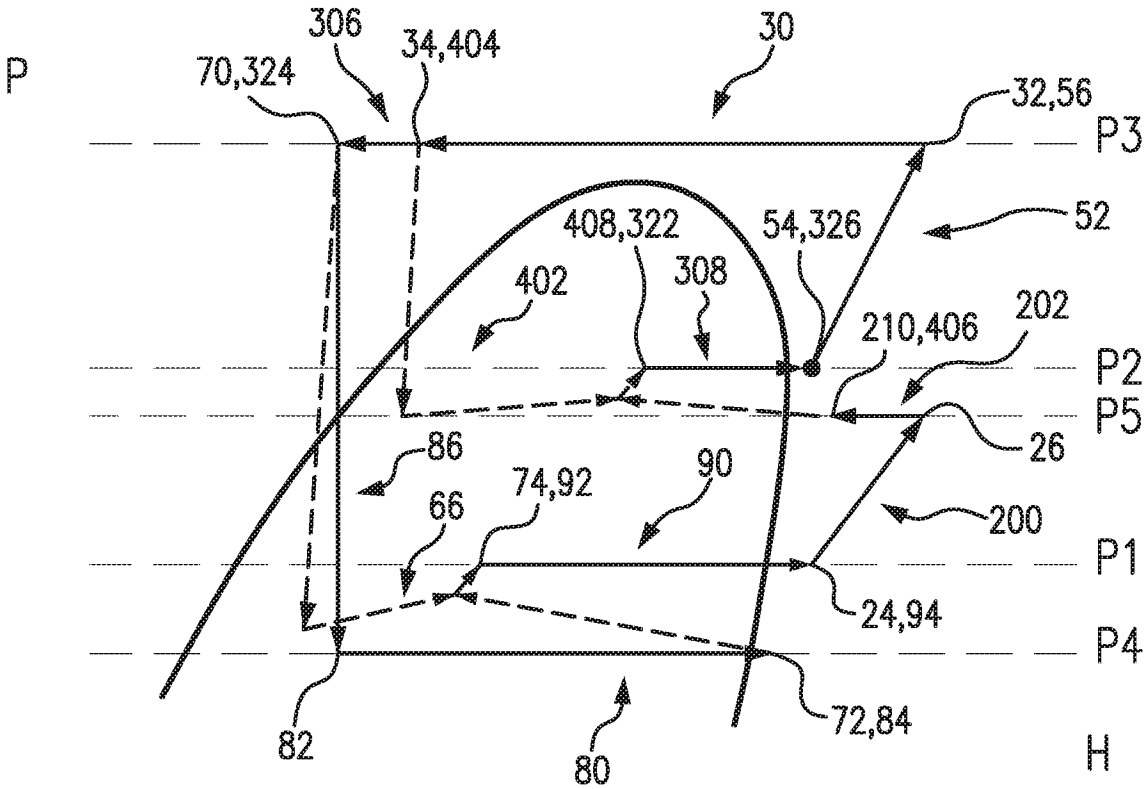
FIG. 9 is a simplified pressure-enthalpy diagram of the system of FIG. 8.

FIG. 9 is a P-H diagram for the system 400.

Although an embodiment is described above in detail, such description is not intended for limiting the scope of the present disclosure. It will be understood that various modifications may be made without departing from the spirit and scope of the disclosure. For example, when implemented in the remanufacturing of an existing system or the reengineering of an existing system configuration, details of the existing configuration may influence or dictate details of any particular implementation. Accordingly, other embodiments are within the scope of the following claims.

What is claimed is:

1. A system comprising:

a first compressor and a second compressor, wherein respective speeds of the first compressor and second compressor are independently controllable;

an intercooler between the first compressor and the second compressor;

a heat rejection heat exchanger coupled to the first and second compressors to receive refrigerant compressed by the compressors;

means for receiving refrigerant from the heat rejection heat exchanger and reducing an enthalpy of a first portion of the received refrigerant while increasing an enthalpy of a second portion, said second portion being returned to the second compressor;

an ejector having:

a primary inlet coupled to the means to receive a first flow of the reduced enthalpy refrigerant;

a secondary inlet; and an outlet coupled to the first compressor to return refrigerant to the first compressor;

a first heat absorption heat exchanger coupled to the means to receive a second flow of the reduced enthalpy refrigerant and upstream of the secondary inlet of the ejector; and a second heat absorption heat exchanger between the outlet of the ejector and the first compressor.

2. The system of claim 1 wherein the means comprises:

a flash tank having:

an inlet coupled to the heat rejection heat exchanger to receive refrigerant from the heat rejection heat exchanger;

a gas outlet coupled to the second compressor to deliver refrigerant to the second compressor; and a liquid outlet upstream of the ejector primary inlet and the first heat absorption heat exchanger.

3. The system of claim 2 further comprising:

an expansion device between the heat rejection heat exchanger and the flash tank inlet.

4. The system of claim 2 wherein:

a single phase gas flow exits the gas outlet; and a single phase liquid flow exits the liquid outlet.

5. A method for operating the system of claim 2 comprising running the first and second compressors in a first mode wherein:

the refrigerant is compressed in the first and second compressors;

refrigerant received from the first and second compressors by the heat rejection heat exchanger rejects heat in the heat rejection heat exchanger to produce initially cooled refrigerant;

the refrigerant received by the flash tank from the heat rejection heat exchanger splits into said first portion and said second portion;

the first portion passes from the liquid outlet and is further split into said first flow received by the ejector primary inlet and a second flow passed through the first heat absorption heat exchanger to the ejector secondary inlet; and the first and second flows merge in the ejector and are discharged from the ejector outlet and passed through the second heat absorption heat exchanger to the first compressor.

6. The system of claim 1 wherein the means comprises:

an economizer expansion device coupled to the heat rejection heat exchanger to receive refrigerant second portion from the heat rejection heat exchanger;

an economizer heat exchanger having:

a first leg coupled to the heat rejection heat exchanger to receive the refrigerant first portion from the heat rejection heat exchanger; and a second leg coupled to the economizer expansion device to receive the second portion.

7. The system of claim 1 wherein the means comprises:

a second ejector having:

a primary inlet coupled to the heat rejection heat exchanger to receive the refrigerant second portion from the heat rejection heat exchanger;

a secondary inlet coupled to the first compressor to receive refrigerant from the first compressor; and an outlet; and an economizer heat exchanger having:

a first leg coupled to the heat rejection heat exchanger to receive the refrigerant first portion from the heat rejection heat exchanger; and a second leg coupled to the second ejector outlet to receive the second portion.

8. The system of claim 1 further comprising:

an expansion device between the means and the inlet of the first heat absorption heat exchanger.

9. The system of claim 1 wherein:

the system has no other ejector.

10. The system of claim 1 wherein:

the system has no other heat absorption heat exchanger.

11. The system of claim 1 wherein:

the first heat absorption heat exchanger and the second heat absorption heat exchanger are positioned so that an airflow is driven by a fan to pass over both the first heat absorption heat exchanger and the second heat absorption heat exchanger to provide humidity control for a conditioned space.

12. The system of claim 1 wherein:

refrigerant comprises at least 50% carbon dioxide, by weight.

13. A method for operating the system of claim 1 comprising running the first and second compressors in a first mode wherein:

the refrigerant is compressed in the first and second compressors;

refrigerant received from the first and second compressors by the heat rejection heat exchanger rejects heat in the heat rejection heat exchanger to produce initially cooled refrigerant;

the refrigerant received by the means from the heat rejection heat exchanger splits into said first portion and said second portion;

the first portion is further split into said first flow received by the ejector primary inlet and said second flow passed through the first heat absorption heat exchanger to the ejector secondary inlet; and the first and second flows merge in the ejector and are discharged from the ejector outlet and passed through the second heat absorption heat exchanger to the first compressor.

14. The method of claim 13 wherein:

the flow from the heat rejection heat exchanger is supercritical, the second portion of the first flow is mostly sub-critical vapor, and the first portion of the first flow is mostly sub-critical liquid.

15. The method of claim 13 wherein:

operation in the first mode is controlled by a controller programmed to control operation of the ejector, the first and second compressors, a controllable expansion device between the liquid outlet and the first heat absorption heat exchanger, and a controllable expansion device between the heat rejection heat exchanger and a flash tank of the means so as to optimize system efficiency;

the expansion device controls the superheat of the refrigerant at the exit of the first heat absorption heat exchanger;

the ejector controls the superheat of the refrigerant at the exit of the second heat absorption heat exchanger; and the expansion device controls the state at the exit of the heat rejection heat exchanger.

16. The method of claim 15 wherein:

the first heat absorption heat exchanger and second heat absorption heat exchanger are positioned so that an airflow passes over both in series; and the controller is programmed to control humidity of the airflow.

17. The system of claim 1 wherein:

the first compressor and the second compressor discharge in parallel to a discharge line.

18. The system of claim 1 wherein:

refrigerant discharged by the first compressor and second compressor mix at different respective enthalpies, with the first compressor discharging at a higher enthalpy than the second compressor.

19. A system comprising:

a first compressor and a second compressor, wherein respective speeds of the first compressor and second compressor are independently controllable;

a heat rejection heat exchanger coupled to the first and second compressors to receive refrigerant compressed by the compressors;

means for receiving refrigerant from the heat rejection heat exchanger and reducing an enthalpy of a first portion of the received refrigerant while increasing an enthalpy of a second portion, said second portion being returned to the second compressor;

an ejector having:

a primary inlet coupled to the means to receive a first flow of the reduced enthalpy refrigerant;

a secondary inlet; and an outlet coupled to the first compressor to return refrigerant to the first compressor;

a first heat absorption heat exchanger coupled to the means to receive a second flow of the reduced enthalpy refrigerant and upstream of the secondary inlet of the ejector; and a second heat absorption heat exchanger between the outlet of the ejector and the first compressor, wherein the means comprises:

a second ejector having:

a primary inlet coupled to the heat rejection heat exchanger to receive the refrigerant second portion from the heat rejection heat exchanger;

a secondary inlet coupled to the first compressor to receive refrigerant from the first compressor; and an outlet; and an economizer heat exchanger having:

a first leg coupled to the heat rejection heat exchanger to receive the refrigerant first portion from the heat rejection heat exchanger; and a second leg coupled to the second ejector outlet to receive the second portion.

* * * * *